US007411555B2

(12) United States Patent
McInnis

(10) Patent No.: US 7,411,555 B2
(45) Date of Patent: Aug. 12, 2008

(54) FOLDED MONOPLOLE ANTENNA, BENT, TAPPED, OR BOTH, AND SYSTEMS INCORPORATING SAME

(75) Inventor: A. J. McInnis, Santa Rosa, CA (US)

(73) Assignee: Texas Instruments Incorporated, Dallas, TX (US)

( * ) Notice: Subject to any disclaimer, the term of this patent is extended or adjusted under 35 U.S.C. 154(b) by 615 days.

(21) Appl. No.: 10/716,798

(22) Filed: Nov. 19, 2003

(65) Prior Publication Data

US 2004/0166908 A1 Aug. 26, 2004

Related U.S. Application Data

(60) Provisional application No. 60/448,755, filed on Feb. 20, 2003.

(51) Int. Cl.
*H01Q 1/24* (2006.01)

(52) U.S. Cl. ..... 343/702; 343/795; 343/828

(58) Field of Classification Search ..... 343/702, 343/700 MS, 826, 803, 804, 713, 795, 828, 343/829

See application file for complete search history.

(56) References Cited

U.S. PATENT DOCUMENTS

| | | | | | |
|---|---|---|---|---|---|
| 2,045,987 | A * | 6/1936 | Green | ..... | 343/730 |
| 4,438,437 | A * | 3/1984 | Burgmyer | ..... | 343/770 |
| 5,151,707 | A * | 9/1992 | Kumpfbeck et al. | ..... | 343/705 |
| 5,289,198 | A * | 2/1994 | Altshuler | ..... | 343/729 |
| 6,008,766 | A * | 12/1999 | Maeda et al. | ..... | 343/713 |
| 6,016,128 | A * | 1/2000 | Imamura et al. | ..... | 343/741 |
| 6,054,955 | A * | 4/2000 | Schlegel et al. | ..... | 343/702 |

OTHER PUBLICATIONS

Walsin Technology Corporation, "Multilayer Ceramic Antenna RFANT Series 2.4 GHz ISM Band Working Frequency," Aug. 2002, 9 pgs.

* cited by examiner

*Primary Examiner*—Michael C. Wimer
(74) *Attorney, Agent, or Firm*—Steven A. Shaw; W. James Brady; Frederick J. Telecky, Jr.

(57) ABSTRACT

Various antenna designs that are small and cost effective are disclosed. In one design, the antenna is a bent and folded monopole antenna. In another design, the antenna is a folded and tapped monopole antenna. In yet another design, the antenna is a folded, bent, and tapped monopole antenna. The antennas may be part of a system using two back-to-back symmetric antennas. The antennas may be part of a modem, such as a wireless computer modem or a wireless handset.

16 Claims, 4 Drawing Sheets

800
810
805
0
10
20
30
40
50
60
70
80
90
100
110
120
130
140
150
160
170
180
190
200
210
220
230
240
250
260
270
280
290
300
310
320
330
340
350
-40
-45
-50
-55
-60
-65
-70
ANTENNA 300A
ANTENNA 300B

THROUGHPUT (Mbps)
8.0
7.0
6.0
5.0
4.0
3.0
2.0
1.0
0.0
1 2 3 4 5 6 7 8 9 10 11 12 13 14 15 16 17 18 19 20 21 22
LOCATION NUMBER
REFERENCE ANTENNA AVE PUT
REFERENCE ANTENNA AVE GET
TEST ANTENNA AVE PUT
TEST ANTENNA AVE GET

FOLDED MONOPLOLE ANTENNA, BENT, TAPPED, OR BOTH, AND SYSTEMS INCORPORATING SAME

PRIORITY CLAIM

This application claims priority to U.S. Provisional Patent Application Ser. No. 60/448,755, filed on Feb. 20, 2003, entitled "Antenna, Printed Circuit Tapped Folded Monopole, WLAN Application," incorporated herein by reference.

BACKGROUND

The increasing use of wireless communications leads to a need for clearer transmissions while reducing the overall size of communications devices. The move to smaller communications devices has caused a need for new antenna designs and systems to use them. Traditional ceramic chip antennas are small but costly. It is thus desirable to implement a small, cost-effective antenna.

SUMMARY

There are disclosed herein various antenna embodiments that are small and cost effective. In one embodiment, the antenna is a bent and folded monopole antenna. In another embodiment, the antenna is a folded and tapped monopole antenna. In yet another embodiment, the antenna is a folded, bent, and tapped monopole antenna. The antennas may be part of a system using two back-to-back symmetric antennas. The antennas may be part of a modem, such as a wireless computer modem or a wireless handset.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

BRIEF DESCRIPTION OF THE DRAWINGS

For a more detailed description of various embodiments of the present invention, reference will now be made to the accompanying drawings, wherein.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims, unless otherwise specified. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
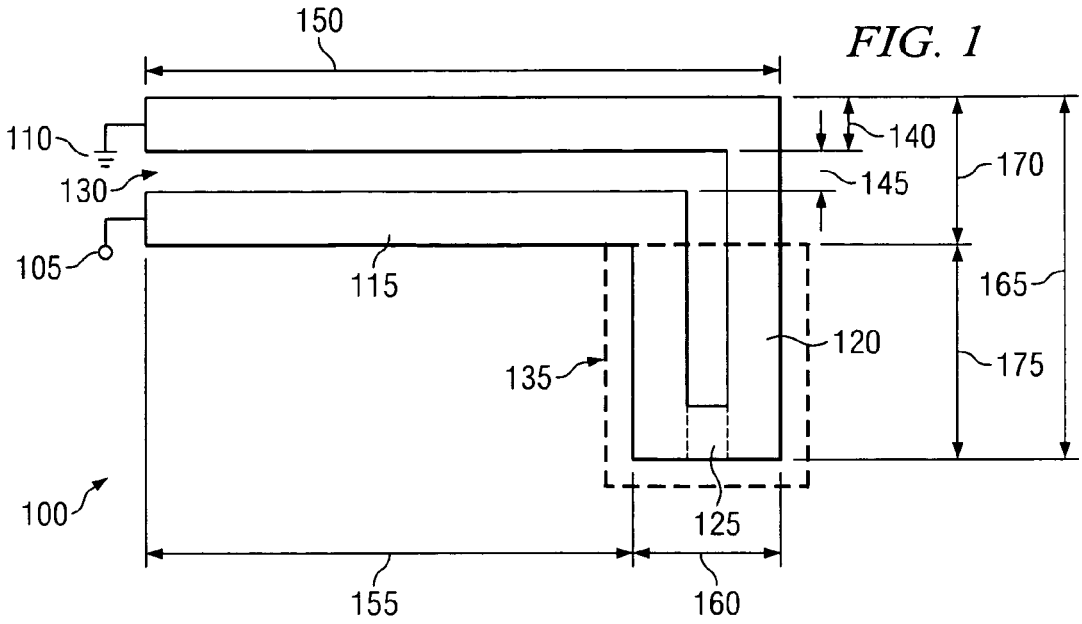
FIG. 1 shows a diagram of a folded and bent monopole antenna, according to one embodiment of the present invention.

Referring now to FIG. 1, a diagram of a folded and bent monopole antenna 100, according to one embodiment of the present invention, is shown. The folded and bent monopole antenna 100 may be coupled to a signal junction 105 and a ground 110. A body of the folded and bent monopole antenna 100 may be described as including a first "L-shaped" section 115, a second "L-shaped" section 120, and a joining section 125.

The "folded" notation of the folded and bent monopole antenna 100 comes from a separation 130 between the signal junction 105 and the ground 110. A "bent" part 135 of the folded and bent monopole antenna 100 is shown inside the dashed lines. Although the bent part 135 is shown connected to the remainder of the folded and bent monopole antenna 100 by a ninety-degree angle, other angles are contemplated and may be designed for as desired or the bending may be achieved by a curve.

A width of the body the folded and bent monopole antenna 100 is shown as dimension 140. The separation 130 of the folded and bent monopole antenna 100 has a dimension 145. The folded and bent monopole antenna 100 has a dimension 150, shown here as a left-right width. The folded and bent monopole antenna 100 has a dimension 155, shown here as a distance from an end to a bend. The folded and bent monopole antenna 100 has a dimension 160, shown here as a width of the bent portion 135. Note that as shown, the dimension 150 is the sum of the dimension 155 and the dimension 160.

The folded and bent monopole antenna 100 has a dimension 165, shown here as a top-bottom height. The folded and bent monopole antenna 100 has a dimension 170, shown here as a top-bottom height of the folded part of the body of the folded and bent monopole antenna 100. The folded and bent monopole antenna 100 has a dimension 175, shown here as a top-bottom height of the bent portion 135. Note that as shown, the dimension 165 is the sum of the dimension 170 and the dimension 175. As shown, in one embodiment, FIG. 1 is drawn to relative scale. In other embodiments, the relative dimensions differ while still expressing desirable characteristics of the present invention.

Figure 2:
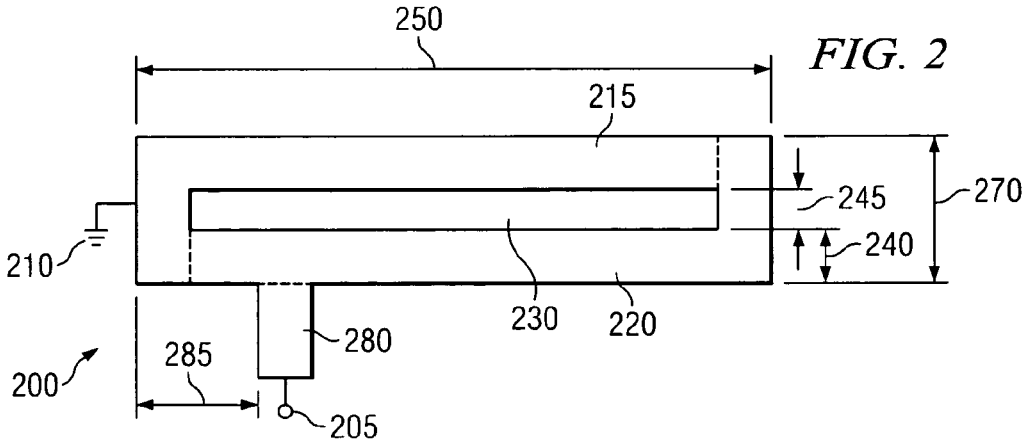
FIG. 2 shows a diagram of a folded and tapped monopole antenna, according to one embodiment of the present invention.

Referring now to FIG. 2, a diagram of a folded and tapped monopole antenna 200, according to one embodiment of the present invention, is shown. The folded and tapped monopole antenna 200 may be coupled to a signal junction 205 and a ground 210. A body of the folded and tapped monopole antenna 200 may be described as including a first "L-shaped" section 215 and a second "L-shaped" section 220.

The "folded" notation of the folded and tapped monopole antenna 200 comes from a separation 230 between the first "L-shaped" section 215 and the second "L-shaped" section 220. A width of the body the folded and tapped monopole antenna 200 is shown as dimension 240. The separation 230 of the folded and tapped monopole antenna 200 has a dimension 245. The folded and tapped monopole antenna 200 has a dimension 250, shown here as a left-right width. The folded and tapped monopole antenna 200 has a dimension 270, shown here as a top-bottom height of the folded body of the folded and tapped monopole antenna 200.

The "tapped" notation of the folded and tapped monopole antenna 200 due to the tap 280. As shown, the signal junction is coupled to the tap 280. The tap 280 is shown located a distance 285 from an end of the folded and tapped monopole antenna 200. Although the tap 280 is shown with the width of the body of the folded and tapped monopole antenna 200, other widths are contemplated and may be designed for as desired. Different locations of the tap 280 and different distances 285 from the end of the folded and tapped monopole antenna 200 are contemplated and may be designed for as desired. As shown, in one embodiment, FIG. 2 is drawn to relative scale. In other embodiments, the relative dimensions differ while still expressing desirable characteristics of the present invention.

Figure 3A:
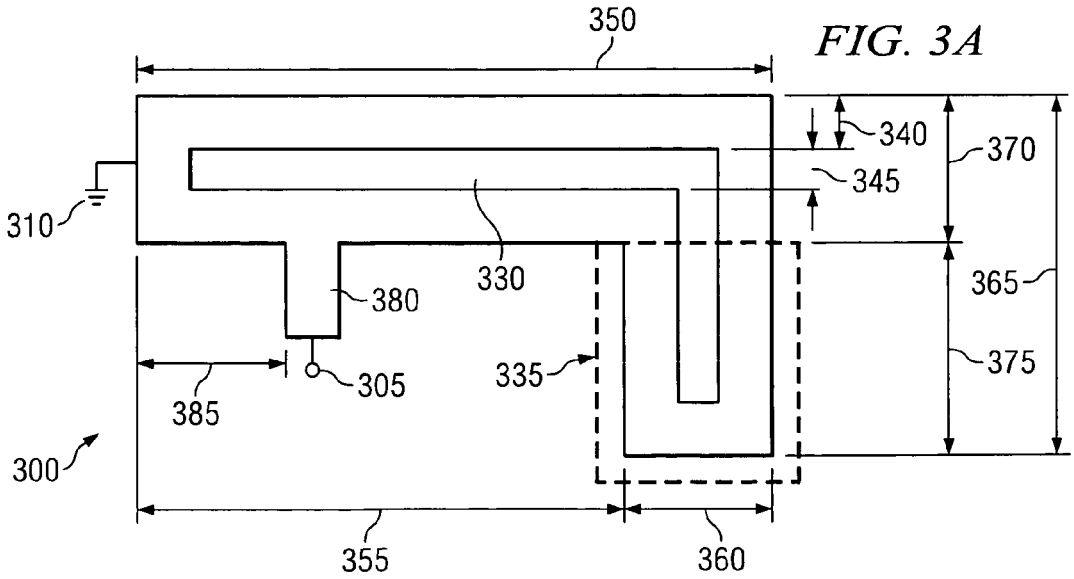
FIGS. 3A and 3B show a folded, bent, and tapped monopole antenna, according to one embodiment of the present invention.

Referring now to FIG. 3A, a diagram of a folded, bent, and tapped monopole antenna 300, according to one embodiment of the present invention, is shown. The folded, bent, and tapped monopole antenna 300 may be coupled to a signal junction 305 and a ground 310. The "folded" notation of the folded, bent, and tapped monopole antenna 300 comes from a separation 330 between the sections of the body of the folded, bent, and tapped monopole antenna 300. A "bent" part 335 of the folded and bent monopole antenna 300 is shown inside the dashed lines. Although the bent part 335 is shown connected to the remainder of the folded, bent, and tapped monopole antenna 300 by a ninety-degree angle, other angles are contemplated and may be designed for as desired.

A width of the body the folded, bent, and tapped monopole antenna 300 is shown as dimension 340. The separation 330 of the folded, bent, and tapped monopole antenna 300 has a dimension 345. The folded, bent, and tapped monopole antenna 300 has a dimension 350, shown here as a left-right width. The folded, bent, and tapped monopole antenna 300 has a dimension 355, shown here as a distance from an end to a bend. The folded, bent, and tapped monopole antenna 300 has a dimension 360, shown here as a width of the bent portion 335. Note that as shown, the dimension 350 is the sum of the dimension 355 and the dimension 360.

The folded, bent, and tapped monopole antenna 300 has a dimension 365, shown here as a top-bottom height. The folded, bent, and tapped monopole antenna 300 has a dimension 370, shown here as a top-bottom height of the folded part of the body of the folded, bent, and tapped monopole antenna 300. The folded, bent, and tapped monopole antenna 300 has a dimension 375, shown here as a top-bottom height of the bent portion 135. Note that as shown, the dimension 365 is the sum of the dimension 370 and the dimension 375.

The "tapped" notation of the folded, bent, and tapped monopole antenna 300 is due to the tap 380. As shown, the signal junction 305 is coupled to the tap 280. The tap 280 is shown located a distance 385 from an end of the folded, bent, and tapped monopole antenna 300. Although the tap 380 is shown with the width of the body of the folded, bent, and tapped monopole antenna 300, other widths are contemplated and may be designed for as desired. Different locations of the tap 380 and different distances 385 from the end of the folded, bent, and tapped monopole antenna 300 are contemplated and may be designed for as desired.

Figure 3B:
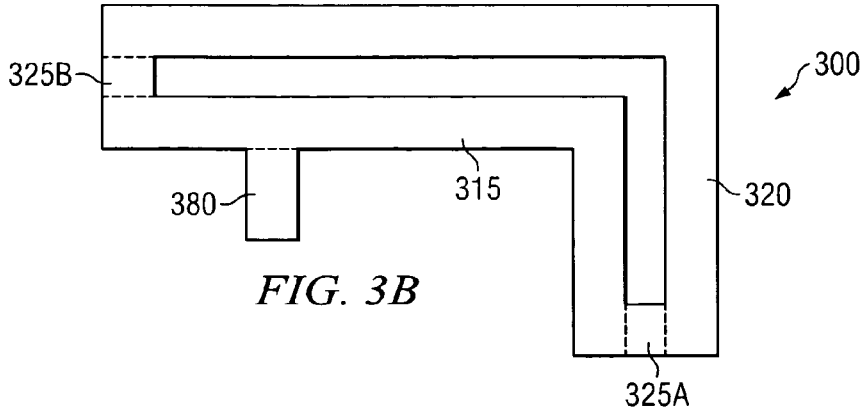

Referring now to FIG. 3B, a diagram of the folded, bent, and tapped monopole antenna 300, according to the embodiment of FIG. 3A, shown. The folded, bent, and tapped monopole antenna 300 may be described as including a first "L-shaped" section 315, a second "L-shaped" section 320, and one or more sections 325. As shown, the folded, bent, and tapped monopole antenna 300 includes a section 325A and a section 325B, each section 325 joining the first "L-shaped" section 315, a second "L-shaped" section 320. Also as shown, the tap 380 is connected to the first "L-shaped" section 315. Different locations of the tap 380 and different distances from the end of the folded, bent, and tapped monopole antenna 300 are contemplated and may be designed for as desired.

Figure 4:
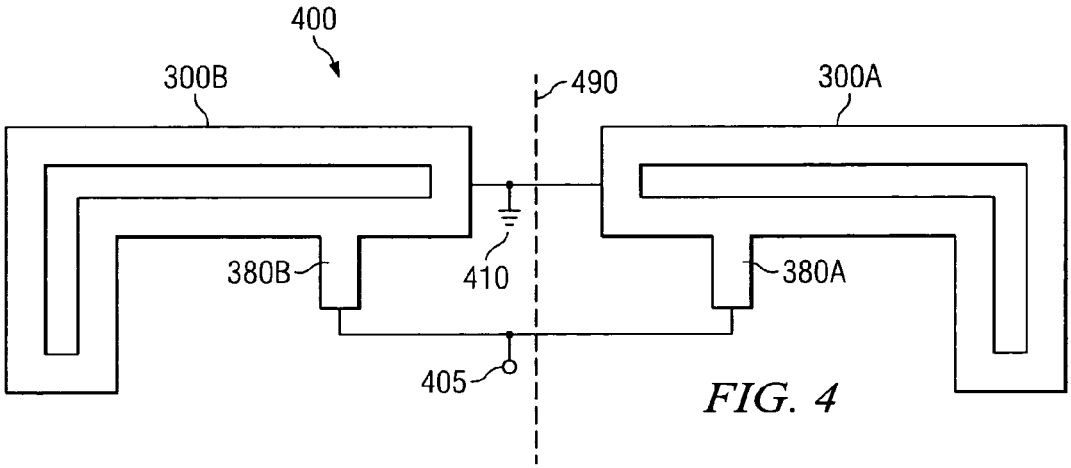
FIG. 4 shows a system of two symmetrical folded, bent, and tapped monopole antennas, according to one embodiment of the present invention.

Referring now to FIG. 4, an antenna system 400 of two folded, bent, and tapped monopole antennas 300A and 300B, according to one embodiment of the present invention, is shown. As shown, the first folded, bent, and tapped monopole antenna 300A is located adjacent to the second folded, bent, and tapped monopole antenna 300B, approximately about a line of symmetry 490. Also as shown, a signal junction 405 is coupled to the tap 380A of the first folded, bent, and tapped monopole antenna 300A and the tap 380B of the second folded, bent, and tapped monopole antenna 300B. A ground 410 is coupled to and couples an end of the each of the first folded, bent, and tapped monopole antenna 300A and the second folded, bent, and tapped monopole antenna 300B, across the line of symmetry 490. Note that each tap 380A and 380B may also couple to separate signal junctions 405A and 405B, respectively (not shown). Note that although the antenna system 400 is shown including the folded, bent, and tapped monopole antennas 300A and 300B, in another embodiment, the antenna system 400 includes two folded and bent monopole antennas 100A and 100B. In still another embodiment, the antenna system 400 includes two folded and tapped monopole antennas 200A and 200B.

Figure 5:
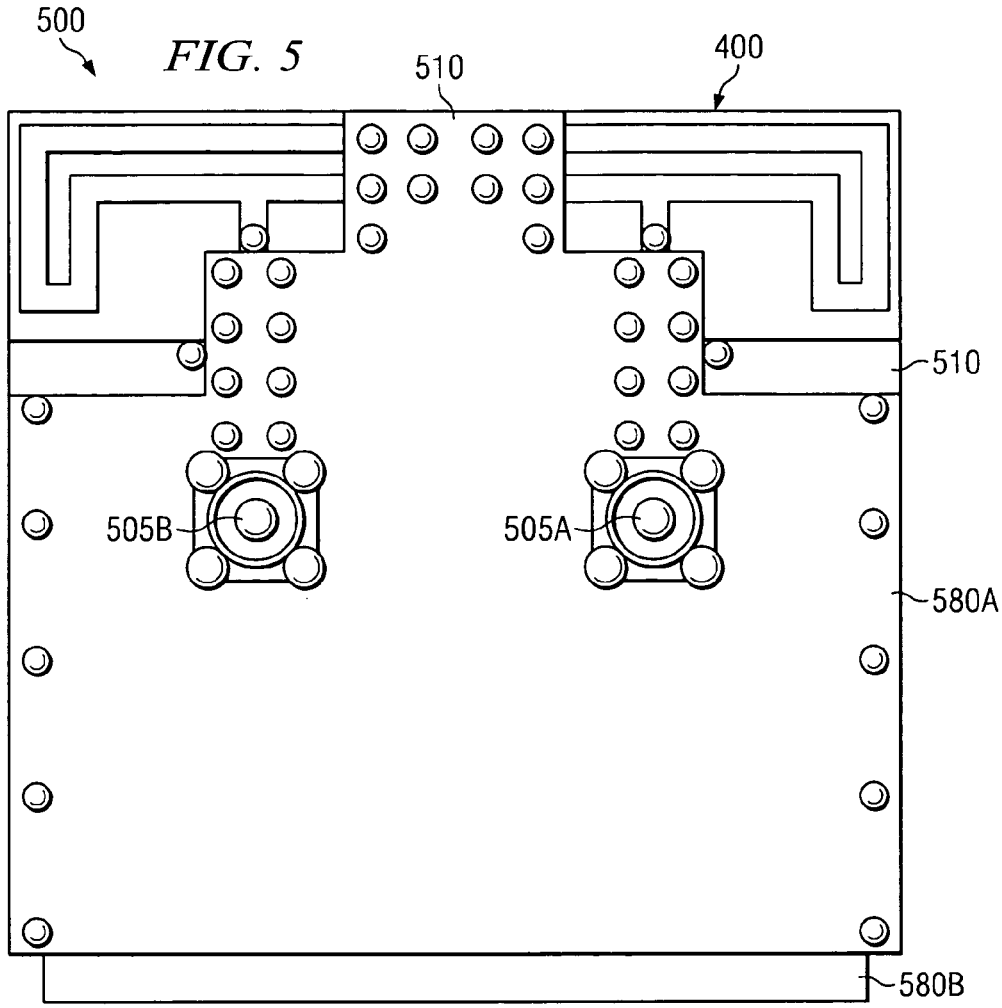
FIG. 5 shows a card including the system of two symmetrical folded, bent, and tapped monopole antennas of FIG. 4, according to one embodiment of the present invention.

Referring now to FIG. 5, a card 500 including the antenna system 400 of FIG. 4, according to one embodiment of the present invention, is shown. The card 500 includes at least 3 layers. A first layer 580A is seen covering the surface of the card 500. A second layer is seen at the lower edge of the card 500. A third layer is a center ground layer 510, which is seen at the left and right edges of the card near the antenna system 400. Note that separate signal junctions 505A and 505B are shown, each coupled to the respective tap 380 of the respective antenna 300 of the antenna system 400.

Note that other embodiments of the antenna system 400 may also be included in the card 500. Note that the size and format of the card 500 may be a wireless modem card, such as in a PC Card format, such as defined in PC Card Standard 8.0 Release— April 2001, which is hereby incorporated by reference in its entirety. The card 500 may also conform to the IEEE Standard 802.11b Compact Flash Plus Reference Design, which is hereby incorporated by reference in its entirety.

Figure 6A:
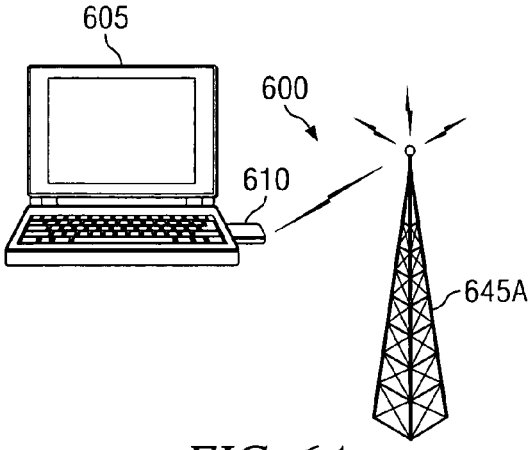
FIG. 6A shows a wireless computer system with wireless modem card in wireless communication with a communications location, according to one embodiment of the present invention.

Referring now to FIG. 6A, a wireless computer system 605 with a wireless modem card 610 in wireless communication with a communications location 645A, according to one embodiment of the present invention, is shown. The wireless modem card 610 may include the antenna system 400, and may include any one or more of the antennas 100, 200, or 300. In one embodiment, the wireless computer system 605 includes a wireless modem card 610 that is internally mounted. In another embodiment, the wireless computer system 605 includes a wireless modem card 610 that is externally inserted and readily removable.

Figure 6B:
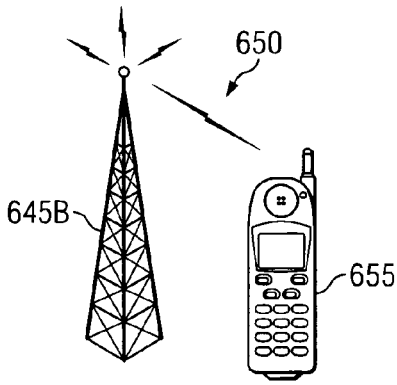
FIG. 6B shows a wireless handset in wireless communication with a communications location, according to one embodiment of the present invention.

Referring now to FIG. 6B, a wireless handset 655 in wireless communication with a communications location 645B, according to one embodiment of the present invention, is shown. The wireless handset 655 may include the antenna system 400, and may include any one or more of the antennas 100, 200, or 300.

Figure 7:
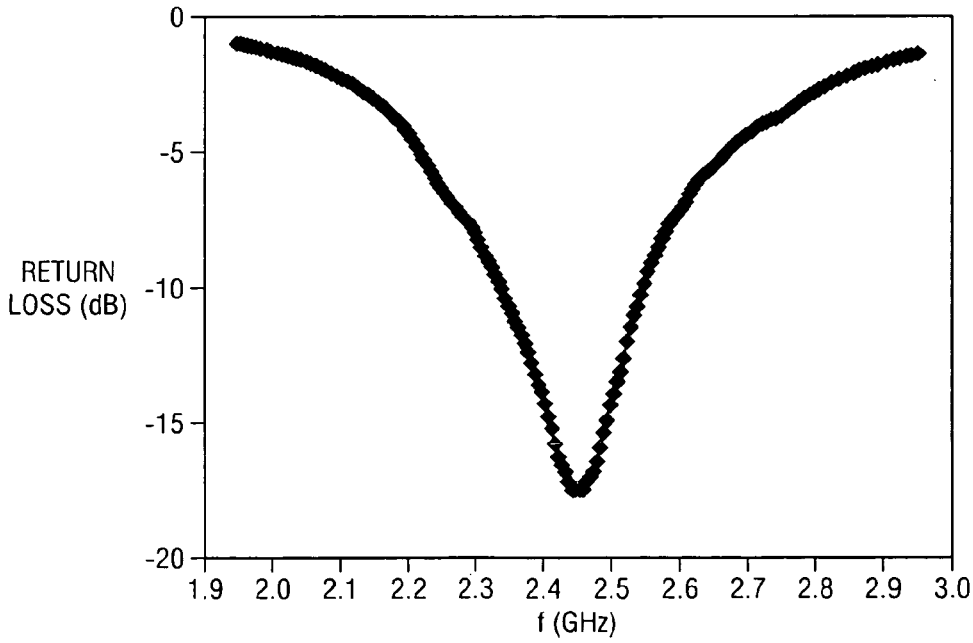
FIG. 7 illustrates the measured return loss of a 2.4-2.5 GHz embodiment of the system of FIG. 4.

Referring now to FIG. 7, the measured return loss of a 2.4-2.5 GHz embodiment of the antenna system 400 of FIG. 4 is illustrated. The return loss is greater than 10 dB from 2.34 to 2.545 GHZ. The 2.4-2.5 GHz embodiment has the following dimensions:

| | Dimension | | | |
|---|---|---|---|---|
| | 340 | 345 | 350 | 365 |
| Approximate Value | 0.062" | 0.032" | 0.575" | 0.41" |

The dimensions 355, 375, 385 are chosen to get an impendence (Z) near 50 ohms in the frequency range of interest. The separation distance across the line of symmetry 490 is approximately 0.14". The antennas 300A and 300B are printed on the board surface. Note that the folded and bent monopole antenna 300 has a wide bandwidth at around 150 ohms of impedance in the 2.4-2.5 GHz embodiment, without the tap 380. The variation of length 350 may also be used to lower the impedance to 50 ohms for the folded and bent monopole antenna 300.

Figure 8:
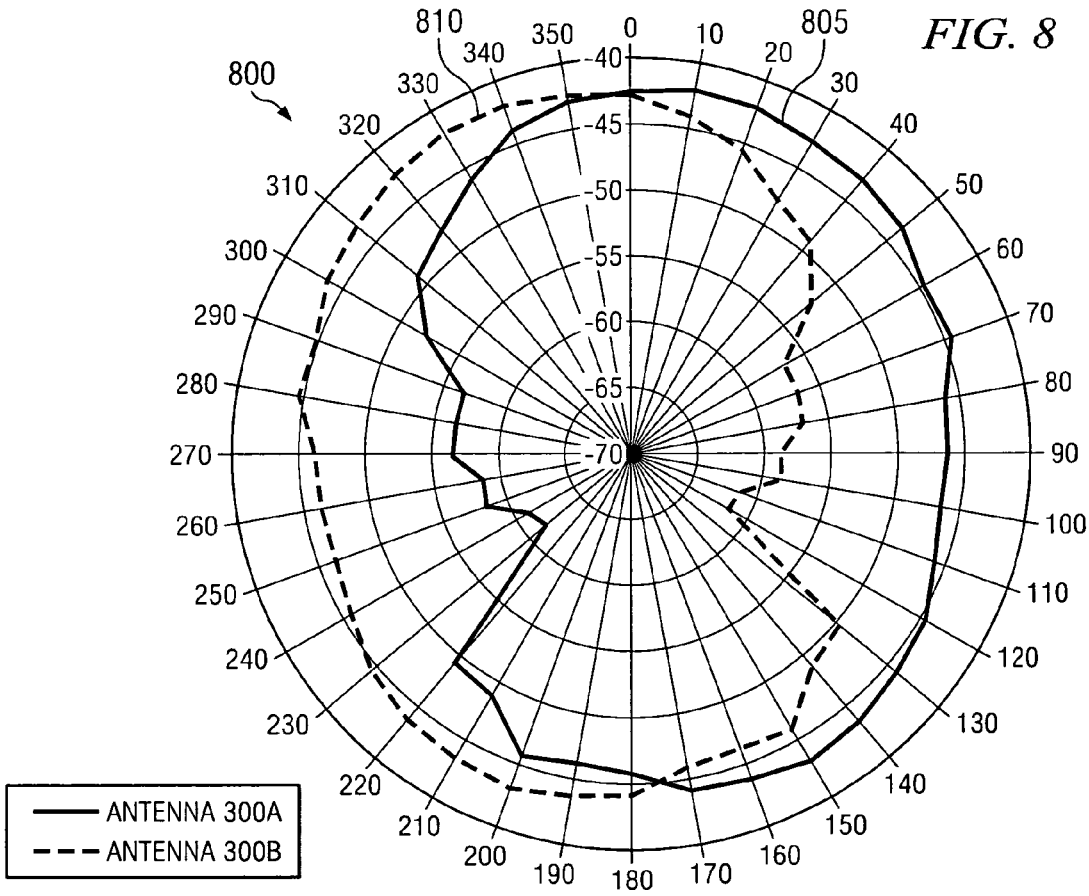
FIG. 8 illustrates the pattern diversity performance of the 2.4-2.5 GHz embodiment of the system of FIG. 4.

Referring now to FIG. 8, the pattern diversity performance of the 2.4-2.5 GHz embodiment of the system of FIG. 4 is illustrated on a circle graph 800. The performance of the antenna 300A is given by line 805. The performance of the antenna 300B is given by line 810. The lobe pattern seen for each antenna 300 is a function of the bent portion 335, and the dimensions 360 and 375. The performance of each antenna 300 individually, as shown by lines 805 and 810, is hemicircular. By using two antennas 300 in the back-to-back symmetrical orientation shown in FIG. 4, a circular pattern is obtained in diversity mode.

Figure 9:
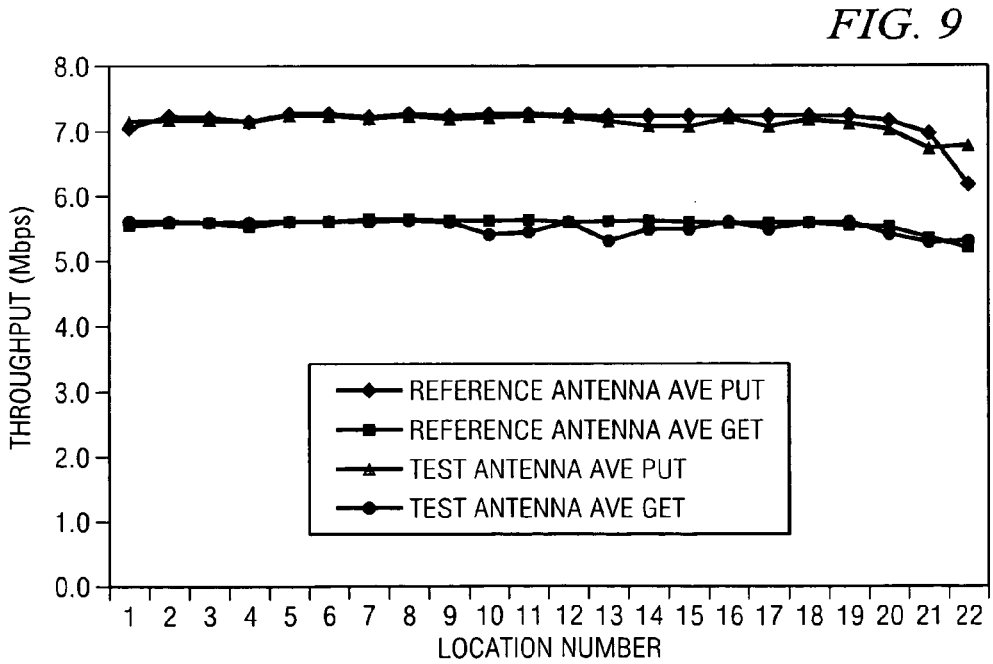
FIG. 9 illustrates the performance of the 2.4-2.5 GHz embodiment of the system of FIG. 4 with respect to a reference antenna.

Referring now to FIG. 9, the performance of the 2.4-2.5 GHz embodiment of the system of FIG. 4 with respect to a reference antenna is illustrated for both "put" and "get" modes. The test antenna was the 2.4-2.5 GHz embodiment of the system of FIG. 4. The reference antenna was the Blue Chip antenna operated in diversity mode. The rate used was PBCC-22 long preamble. The EEPROM was 5.0 Maxim. The 4× mode was disabled. The test was run between two laptops. The experiments were run at twenty-two different locations.

| Data | | Blue Chip Antenna (Standard) | | Test Antenna | |
|---|---|---|---|---|---|
| Distance (ft) | Location | ave put | ave get | ave put | ave get |
| 17 | 1 | 7.13 | 5.57 | 7.24 | 5.63 |
| 17 | 2 | 7.24 | 5.62 | 7.20 | 5.62 |
| 17 | 3 | 7.23 | 5.62 | 7.24 | 5.62 |
| 17 | 4 | 7.19 | 5.55 | 7.21 | 5.60 |
| 33 | 5 | 7.27 | 5.64 | 7.26 | 5.63 |
| 33 | 6 | 7.28 | 5.63 | 7.28 | 5.63 |
| 33 | 7 | 7.26 | 5.64 | 7.28 | 5.63 |
| 33 | 8 | 7.28 | 5.65 | 7.27 | 5.64 |
| 33 | 9 | 7.26 | 5.64 | 7.20 | 5.63 |
| 33 | 10 | 7.28 | 5.63 | 7.22 | 5.44 |
| 33 | 11 | 7.29 | 5.64 | 7.26 | 5.46 |
| 33 | 12 | 7.27 | 5.63 | 7.26 | 5.64 |
| 67 | 13 | 7.28 | 5.64 | 7.20 | 5.34 |
| 67 | 14 | 7.27 | 5.64 | 7.10 | 5.52 |
| 67 | 15 | 7.28 | 5.63 | 7.08 | 5.50 |
| 67 | 16 | 7.27 | 5.59 | 7.26 | 5.63 |
| 83 | 17 | 7.28 | 5.61 | 7.12 | 5.52 |
| 83 | 18 | 7.27 | 5.62 | 7.28 | 5.63 |
| 83 | 19 | 7.27 | 5.57 | 7.15 | 5.63 |
| 116 | 20 | 7.20 | 5.55 | 7.09 | 5.45 |
| 129 | 21 | 7.02 | 5.37 | 6.78 | 5.31 |
| 137 | 22 | 6.23 | 5.22 | 6.79 | 5.34 |

While preferred embodiments of the present invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Accordingly, the scope of protection is not limited by the description set out above. Each and every claim is incorporated into the specification as an embodiment of the present invention.

What is claimed is:

1. An antenna system, comprising:

a first folded monopole antenna including a first tap a distance from an end of the first folded monopole antenna; and a second folded monopole antenna including a second tap an equivalent distance from an end of the second folded monopole antenna;

wherein the first folded monopole antenna and the second folded monopole antenna are approximately positioned about a line of symmetry, and wherein the end of the first folded monopole antenna and the end of the second folded monopole antenna are in close proximity across the line of symmetry, wherein the end of the first folded monopole antenna and the end of the second folded monopole antenna are each configured to couple to ground, and wherein the first tap and the second tap are each configured to receive a signal.

2. The antenna system of claim 1, wherein the first folded monopole antenna and the second folded monopole antenna are printed onto a surface.

3. The antenna system of claim 1, wherein each of the first folded monopole antenna and the second folded monopole antenna covers an area of less than 0.3 square inches.

4. The antenna system of claim 1, wherein the antenna system is configured to receive at least at an approximate frequency of 2.45 GHz.

5. The antenna system of claim 4, wherein the antenna system is further configured with an impedance of approximately 50 ohms.

6. An antenna system, comprising:

a first bent and folded monopole antenna including a first tap a distance from an end of the first folded monopole antenna; and a second bent and folded monopole antenna including a second tap the distance from an end of the second folded monopole antenna;

wherein the first bent and folded monopole antenna and the second bent and folded monopole antenna are approximately positioned about a line of symmetry, and wherein the end of the first bent and folded monopole antenna and the end of the second bent and folded monopole antenna in close proximity across the line of symmetry, wherein the end of the first bent and folded monopole antenna and the end of the second bent and folded monopole antenna are each configured to couple to ground, and wherein the first tap and the second tap are each configured to receive a signal.

7. The antenna system of claim 6, wherein the first bent and folded monopole antenna and the second bent and folded monopole antenna are printed onto a surface.

8. The antenna system of claim 7, wherein the antenna system is printed onto the surface of a card.

9. The antenna system of claim 8, wherein the antenna system is printed onto the surface of a modem card.

10. The antenna system of claim 6, wherein each of the first bent and folded monopole antenna and the second bent and folded monopole antenna covers an area of less than 0.3 square inches.

11. The antenna system of claim 6, wherein the antenna system is configured to receive at least at an approximate frequency of 2.45 GHz.

12. The antenna system of claim 11, wherein the antenna system is further configured with an impedance of approximately 50 ohms.

13. A modem, comprising:

a first bent and folded monopole antenna including a first tap a distance from an end of the first folded monopole antenna; and a second bent and folded monopole antenna including a second tap the distance from an end of the second folded monopole antenna;

wherein the first bent and folded monopole antenna and the second bent and folded monopole antenna are approximately positioned about a line of symmetry, and wherein the end of the first bent and folded monopole antenna and the end of the second bent and folded monopole antenna in close proximity across the line of symmetry, wherein the end of the first bent and folded monopole antenna and the end of the second bent and folded monopole antenna are each configured to couple to ground, and wherein the first tap and the second tap are each configured to receive a signal, wherein the first bent and folded monopole antenna and the second bent and folded monopole antenna are printed onto a surface of the modem.

14. The modem of claim 13, wherein the modem is configured as an internal modem for a computer system.

15. The modem of claim 13, wherein the modem is configured as an externally insertable and removable modem for a computer system.

16. The modem of claim 13, wherein the modem is configured as a wireless handset.

* * * * *